US009388759B2

(12) United States Patent
Estefanous et al.

(10) Patent No.: US 9,388,759 B2
(45) Date of Patent: Jul. 12, 2016

(54) USING ION CURRENT SIGNAL FOR SOOT AND IN-CYLINDER VARIABLE MEASURING TECHNIQUES IN INTERNAL COMBUSTION ENGINES AND METHOD FOR DOING THE SAME

(75) Inventors: Fadi A. Estefanous, Warren, MI (US); Tamer H. Badawy, Detroit, MI (US); Naeim A. Henein, Grosse Pointe Farms, MI (US)

(73) Assignee: Wayne State University, Detroit, MI (US)

( * ) Notice: Subject to any disclaimer, the term of this patent is extended or adjusted under 35 U.S.C. 154(b) by 290 days.

(21) Appl. No.: 14/001,668

(22) PCT Filed: Feb. 28, 2012

(86) PCT No.: PCT/US2012/026873

§ 371 (c)(1),
(2), (4) Date: Dec. 3, 2013

(87) PCT Pub. No.: WO2012/118781

PCT Pub. Date: Sep. 7, 2012

(65) Prior Publication Data

US 2014/0081556 A1 Mar. 20, 2014

Related U.S. Application Data

(60) Provisional application No. 61/447,163, filed on Feb. 28, 2011.

(51) Int. Cl.

| | |
|---|---|
| ***F02D 41/14*** | (2006.01) |
| ***F02D 35/02*** | (2006.01) |
| ***F02D 41/30*** | (2006.01) |

(52) U.S. Cl.

CPC ..... *F02D 41/1467* (2013.01); *F02D 35/021* (2013.01); *F02D 35/023* (2013.01); *F02D 41/1466* (2013.01); *F02D 41/30* (2013.01); *F02D 41/1497* (2013.01)

(58) Field of Classification Search

CPC F02D 41/1466; F02D 41/1467; F02D 35/021
USPC ..... 701/103, 114, 102; 123/536, 406.37, 123/494

See application file for complete search history.

(56) References Cited

U.S. PATENT DOCUMENTS

| | | | | |
|---|---|---|---|---|
| 4,380,986 | A * | 4/1983 | Latsch et al. | 123/687 |
| 4,739,731 | A * | 4/1988 | Habich et al. | 123/494 |
| 7,318,411 | B1 * | 1/2008 | Zhu et al. | 123/406.26 |

(Continued)

FOREIGN PATENT DOCUMENTS

| | | | |
|---|---|---|---|
| DE | 2944834 | A1 * | 5/1981 |
| DE | 10211456 | A1 * | 10/2003 |

(Continued)

OTHER PUBLICATIONS

International Search Report, Serial No. PCT/US2012/026873, Dated Jun. 7, 2012.

*Primary Examiner* — Mahmoud Gimie
(74) *Attorney, Agent, or Firm* — Brinks Gilson & Lione

(57) ABSTRACT

A system and method is provided for the use of the ion current signal characteristics for onboard cycle-by-cycle, cylinder-by-cylinder measurement, for example soot measurement, load measurement such as indicated or brake mean effective pressure, or fuel consumption measurement in an internal combustion engine. The system may acquire an ion current signal, measures one or more of soot, load, fuel consumption and may control the engine operating parameters accordingly.

24 Claims, 11 Drawing Sheets

(56) References Cited

U.S. PATENT DOCUMENTS

| | | | | |
|---|---|---|---|---|
| 2002/0021120 | A1* | 2/2002 | Raichle et al. | 324/96 |
| 2005/0150220 | A1 | 7/2005 | Johnson et al. | |
| 2008/0040020 | A1 | 2/2008 | Henein | |

FOREIGN PATENT DOCUMENTS

| | | | | |
|---|---|---|---|---|
| JP | 05222989 | A | * | 8/1993 |
| SE | 9602536 | A | * | 3/1998 |
| WO | WO 2011/011378 | A1 | | 1/2011 |

* cited by examiner

USING ION CURRENT SIGNAL FOR SOOT AND IN-CYLINDER VARIABLE MEASURING TECHNIQUES IN INTERNAL COMBUSTION ENGINES AND METHOD FOR DOING THE SAME

RELATED APPLICATIONS

The present application is a 371 national stage application of PCT Application No. PCT/US2012/026873, filed Feb. 28, 2012, which application claims the benefit of U.S. Provisional Application No. 61/447,163 filed on Feb. 28, 2011 which is incorporated herein by reference in its entirety.

BACKGROUND

1. Field of the Invention

The present application relates to the use of the characteristics of an ion current sensor signal for onboard measurement of in-cylinder variables such as but not limited to soot, engine load, and fuel consumption, and for the control of different engine parameters accordingly.

2. Description of Related Art

One existing technology in quantitative soot measurement utilizes laser techniques in optically accessible engines. These techniques are used in research facilities only and cannot be applied in commercial engines. Another existing technology uses sampling techniques which require very expensive instrumentation and can also only be applied in research labs. Other technologies have provided some results for soot measurement where a sensor is located in the exhaust pipe or within after treatment devices. The problem of this type of sensors is the slow access to the soot measurement data. Furthermore, this type of sensors is unable to predict the amount of soot attributable to each engine cylinder accurately. This brings us to the conclusion that there is no in-cylinder, low cost technology that is capable of quantitatively and adequately predict the amount of soot produced in commercial engines.

As of engine load and fuel flow, there are several methods for which these parameters can be measured, each with their own advantages, disadvantages and applications. One method is to use the engine speed density. The method involves a manifold absolute pressure sensor (MAP) and intake air temperature. Speed density systems are very sensitive to temperature changes which affect load and fuel calculations.

SUMMARY

A system and method is provided for an onboard in-cylinder soot measurement in an internal combustion engine. The system can be further used in controlling the engine based on a feedback signal from the soot measured. The system acquires an ion current signal and controls the engine operating parameters based on the characteristics of the ion current signal.

Throughout the application examples will be provided with regard to soot, load, and fuel consumption measurements, however, these principles can be applied to other in-cylinder variables as well and such applications are contemplated herein.

A system and method is provided for onboard engine load such as IMEP (Indicated Mean Effective Pressure), BMEP (Brake Mean Effective Pressure) and fuel consumption (FC) measurement in internal combustion engine based on an acquired ion current signal. ISFC (Indicated Specific Fuel Consumption) and BSFC (Brake Specific Fuel Consumption) can be calculated from the measurements mentioned above. The system can be further used in controlling the engine based on a feedback signal obtained from the measured engine load fuel consumption.

The new technique gives the ion-current sensor, located inside the engine cylinder, the ability to detect and accurately measure the amount of soot (black smoke), and mean effective pressure produced from the combustion process on a cyclic basis. Fuel consumption (FC) is also measured on a cylinder-by-cylinder and cycle-by-cycle basis using the ion current signal. This fast response measuring technique can be applied in all engine cylinders in order to provide an onboard feedback signal to the contribution of each cylinder to soot formation, produced power, and fuel consumed.

The system offers a new cost effective and simple technique to measure soot, load, and fuel consumption (FC) inside the combustion chamber using the ion-current signal. The system also provides a fast cycle-by-cycle soot prediction technique to accommodate the engine transient operation. The feedback signal is sent to the engine ECU for better engine control, thereby producing less soot to comply with the EPA stringent emissions rules with no modification to the engine.

The system is cost effective as the sensor involved is the ion sensor. The system provides a fast response soot, load, and fuel consumption (FC) measuring technique, as it depends on electron speed. The system is able to measure the disclosed parameters inside the combustion chamber and on a cycle-by-cycle basis. Further, the system is able to measure soot, load, fuel consumption (FC) in every engine cylinder with no modifications required to the engine block. Accordingly, the system is well suited as an on-board tool for soot, load, and fuel consumption (FC) measurement and provides an efficient, compact design for integration in production models.

Further objects, features and advantages of this application will become readily apparent to persons skilled in the art after a review of the following description, with reference to the drawings and claims that are appended to and form a part of this specification.

BRIEF DESCRIPTION OF THE DRAWINGS

Aspects of this application will be described by way of examples with reference to the accompanying drawings. They serve to illustrate several aspects of the present application, and together with the description provide explanation of the system principles. In the drawings.

DETAILED DESCRIPTION

Figure 1:
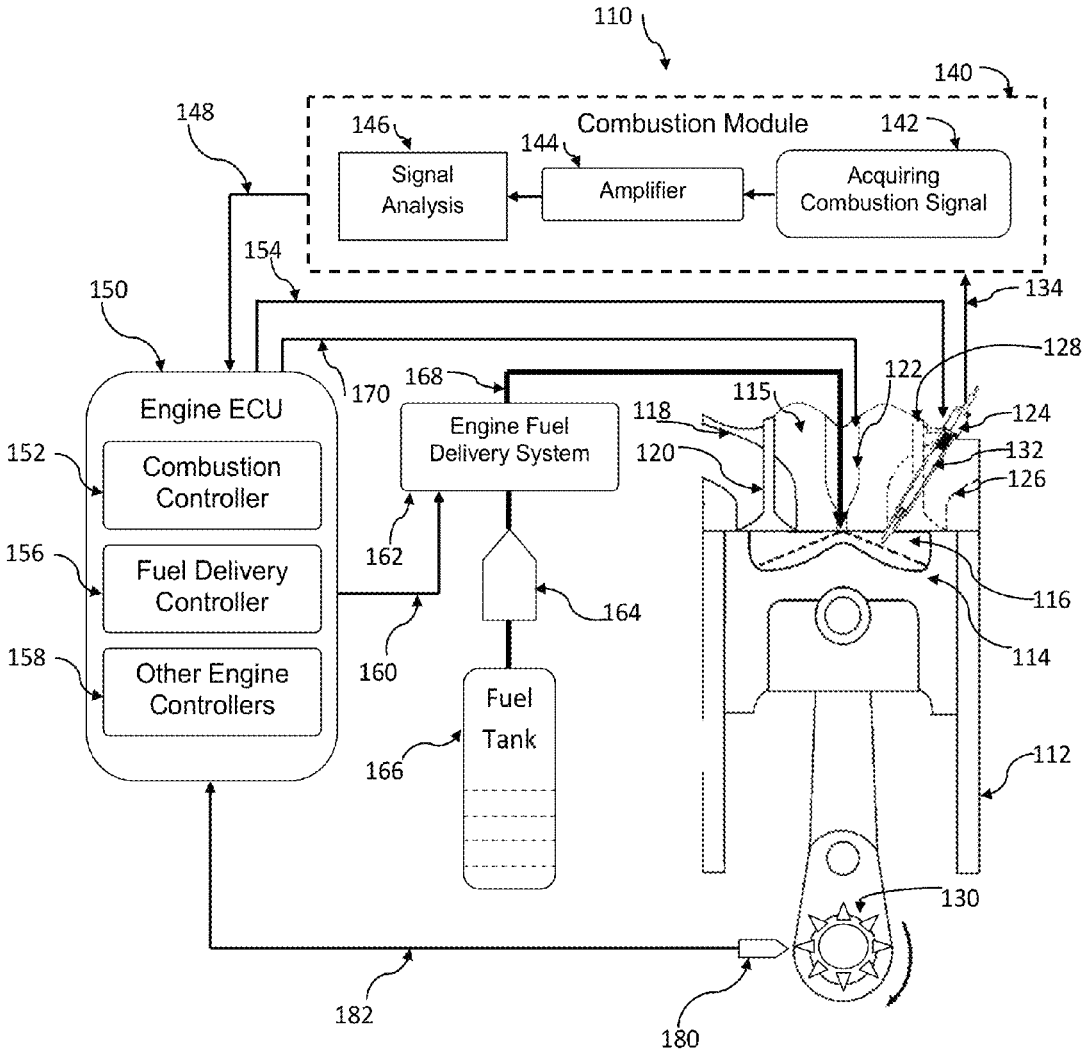
FIG. 1 is an engine system for controlling engine operating parameters based on ion sensor signal characteristics.

Now referring to FIG. 1, a schematic view of a diesel engine 110 is provided. For illustrative purposes the schematic shows a single cylinder of an engine, however, it is readily understood that multiple cylinders may be used in combination to form the engine. The cylinder 112 houses piston 114 allowing for reciprocating motion of the piston 114 within the cylinder 112. The combustion chamber 116 is formed by the cylinder houses 112, the piston 114, and the cylinder head 115. Air, a mixture of air and exhaust gases, or other mixtures of any fluid may be provided into the chamber 116 through an intake manifold 118. The flow of air or mixtures made through the intake manifold 118 may be controlled by intake valve 120. Fuel may be provided into the chamber by a fuel injector 122. A glow plug 124 may be used to facilitate the ignition of the fuel inside the combustion chamber 116 causing reciprocating motion of the piston 114. After combustion, the exhaust gases in the chamber may be released through the exhaust manifold 126. Further, the flow of exhaust may be controlled by an exhaust valve 128 located within the exhaust manifold 126. As may be readily understood, combustion in the chamber 116 causes the piston 114 to move downward causing rotation of the crankshaft 130. The inertia of a flywheel or combustion in other chambers will cause the crankshaft 130 to rotate further thereby causing a reciprocating motion of the piston 114 upward. The glow plug 124 can be turned on by the ECU 150 through an electrical command 154. The glow plug 124 may also include a sensor 132 to monitor activity within the combustion chamber 116 during the entire cycle of the engine. The sensor 132 includes an ion current sensor, a pressure sensor, an optical sensor, or any combination of the above. These sensors may be standalone or integrated with the glow plug or the fuel injector 122. In case of spark ignition (SI) engines, the ion current sensor can be integrated with a spark plug. The sensor signal 134 may be provided to a combustion module 140. The combustion module 140 includes an acquisition module 142 for acquiring the combustion signal and amplifier 144 for enhancing the combustion signal and a signal analysis module 146 to determine certain combustion characteristics based on the enhanced combustion signal. The combustion parameters 148 are then provided to an engine control module 150. The engine control module 150 may then analyze the combustion parameters and control engine operation parameters based on the combustion parameters. In one implementation, the ion current signal may be used to control the engine operating parameters.

The engine control unit 150 includes a combustion controller 152, a fuel delivery controller 156 and other engine controllers 158. The combustion controller 152 may act as a master module that provides a control signal to different engine components such as the glow plug 124 heater, the fuel delivery system 162, or the injector 122. The fuel delivery controller 156 provides a fuel delivery control signal 160 to an engine fuel delivery system 162. The engine fuel delivery system controls the delivery of fuel to the injector 122. The fuel from the tank 166 is delivered by the fuel pump 164 to the fuel delivery system 162. The fuel delivery system 162 distributes the supplied fuel based on a signal 160 from the ECU 150. The fuel is further supplied to the injector 122 through a fuel line 168. In addition, the fuel delivery controller 156 is in communication electronically with the fuel injector 122 to control different injection parameters such as number of injection events, injection duration and timing as noted by line 170. In addition, the other engine controllers 158 control other engine parameters such as engine speed, load, amount of exhaust gas recirculation, variable geometry turbocharger, or other units installed to the engine. Further, an output sensor 180 may be in communication with the crankshaft 130 to measure crank shaft position, and engine speed, torque of the crankshaft, or vibration of the crank shaft, and provide the feedback signal to the engine control unit 150 as denoted by line 182.

Figure 2:
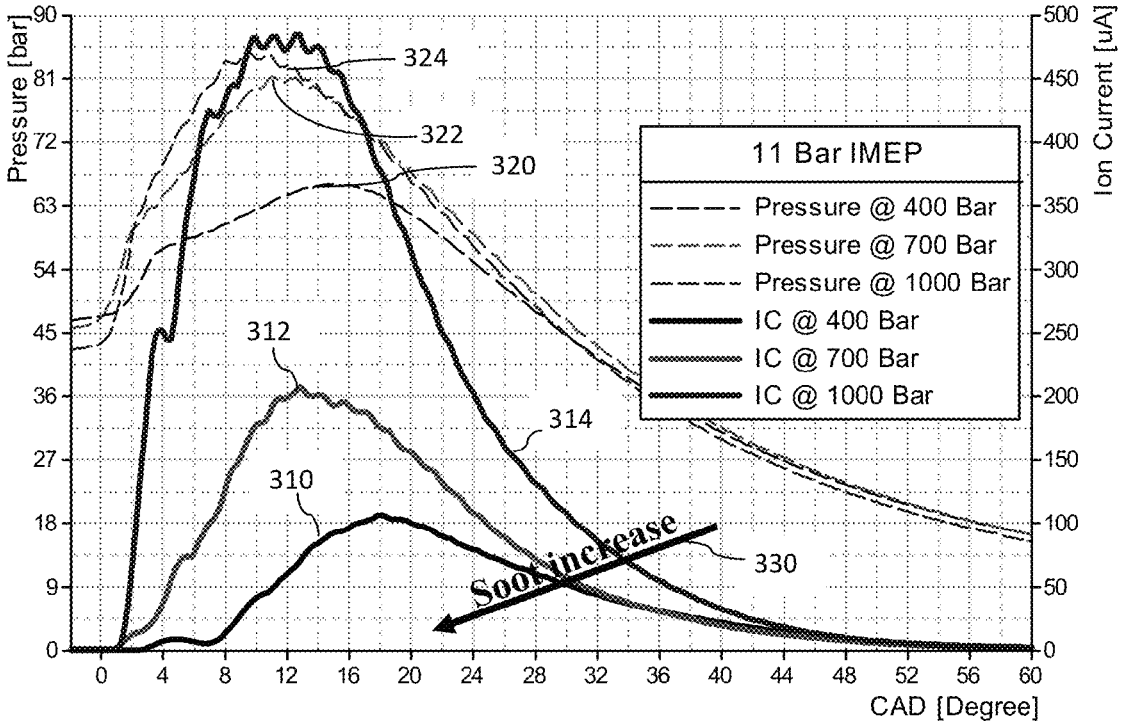
FIG. 2 is a graph illustrating the ion current and pressure for diesel engine at constant engine load with varying injection pressure.

Referring to FIG. 2, a graph is provided of the pressure and corresponding ion current. The graph was derived from preliminary tests done on a heavy duty diesel engine where the ion current, pressure, and soot in-exhaust were measured at different injection pressure while load is kept constant. The engine was controlled using a full accessed open engine control unit (ECU), where engine parameters such as injection timing, injection pressure, intake pressure, and engine speed were controlled. In this specific test, the graph of the ion current and in-cylinder pressure is provided for a constant 11 bar IMEP load. The injection pressure was varied from 400 bar to 1000 bar in steps. Line 310 is the ion current signal at an injection pressure of 400 bar, while line 320 is the in cylinder pressure at an injection pressure of 400 bar. Line 312 is the ion current and injection pressure of 700 bar, while line 322 is the cylinder pressure at an injection pressure of 700 bar. Finally, line 314 is the ion current signal at an injection pressure of 1000 bar and line 324 is the in cylinder pressure at the injection pressure of 1000 bar. The changes in the injection pressure significantly affect the ion current signal characteristics. Additionally, the amount of soot in the exhaust is measured for each of the cycles described above. As denoted by arrow 330, the soot increases as the injection pressure decreases. Further, the increase in soot as denoted by arrow 330 corresponds closely to the change in the ion current signal 310, 312, and 314. For example, the ion current signal 310 at 400 bar injection pressure provides more soot in the exhaust than the ion current signal 314 at an injection pressure of 1000 bar.

Figure 3:
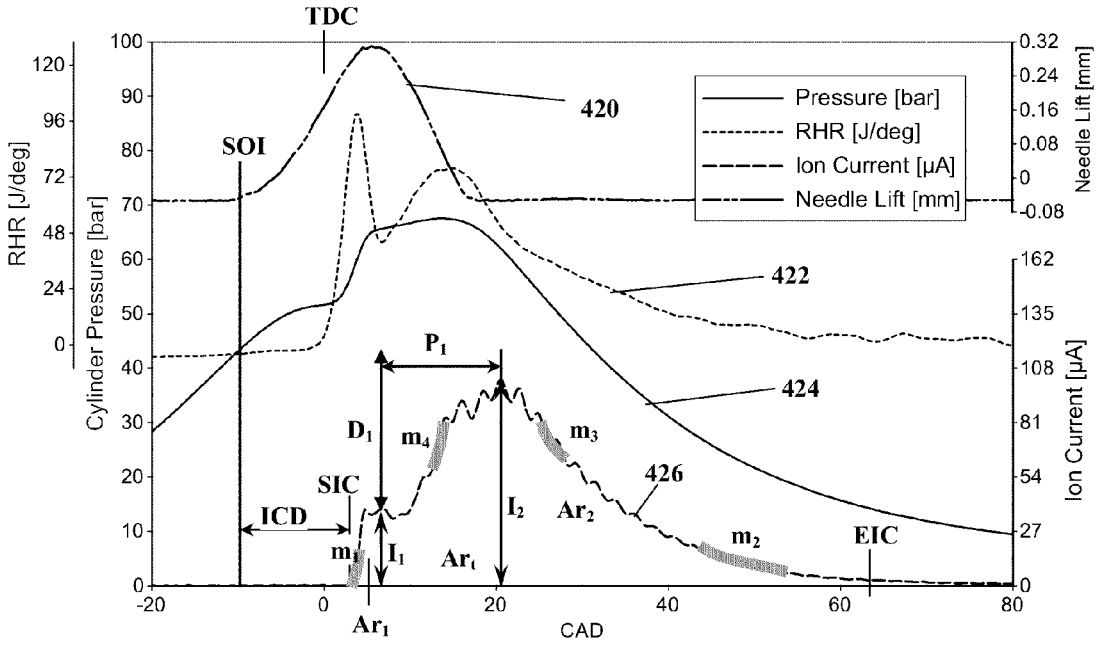
FIG. 3 illustrate the analysis of the ion current signal.

Now referring to FIG. 3, a graph of the pressure trace 424, rate of heat release 422, needle lift signal 420, and ion current signal 426 is provided. Ion current signal parameters are shown in the graph to illustrate an algorithm to control engine operating parameters and indicate in-cylinder variables such as but not limited to amount of soot, engine load, and/or fuel consumption based on the ion current signal. As examples of the parameters deduced from the ion current signal, the start of ion current signal (SIC) timing, which may be accomplished by various thresholding techniques, the ion current slope ($m_1$, $m_2$, $m_3$, $m_4$), where $m_1$ refers to the rate of ion current rise, $m_2$ is the rate of ion current decay, $m_3$ is the rate of the second peak decay, and $m_4$ is the rate of the ion current second peak rise. More slopes may be added depending on the number of peaks of each cycle-to-cycle ion current signal. The slope may be determined as the slope at which the ion current signal crosses an ion current threshold or may be the slope of the ion current signal at a specific position in degrees of the cycle. In some implementations, the slope may be determined at an offset position relative to an event such as the beginning of the ion current signal, the beginning of an ignition event, or some other characteristic marker of the cycle of the cylinder in which the ion current is measured. Further, the slope may be an instantaneous slope or may be an average slope, for example over a few degrees. The ion current delay (ICD) is another ion current parameter which is determined by a reference point which can be but not limited to the SOI (Start of Injection) (for example, as sensed by ECU) or the TDC (Top Dead Center) (for example, as sensed by the cam shaft sensor). Another parameter is the ion current amplitude ($I_1, I_2, I_3, \ldots, I_n$ in case of different peaks) for example, the first peak $I_1$ and second peak $I_2$. The difference between two consecutive amplitudes ($D_1, \ldots, D_n$ in case of different peaks). The ion current peak to peak distance ($P_1, \ldots, P_n$ in case of many peaks). The end of ion current signal timing (EOI), which may be accomplished by various thresholding techniques, and the total area under the curve (Ar) of the ion current signal, the area under the first bump ($Ar_1$), and the area under the second bump ($Ar_2$), and ($Ar_n$) for the area under the bump n. Other parameters may be derived and will become readily apparent to persons skilled in the art In one example, the relationship used to come up with measured parameters may be expressed as predicted parameter (SOOT, IMEP, BMEP, FC)=($A_1, A_2, A_3, A_4$)*Fn (SOI)+($B_1, B_2, B_3, B_4$)*Fn (m)+($C_1, C_2, C_3, C_4$)*Fn (I)+($L_1, \ldots, L_4$)*Fn (P)+($E_1, \ldots, E_4$)*Fn (ICD)+($F_1, \ldots, F_4$)*Fn (Ar)+($H_1, \ldots, H_4$)*Fn (EOI)+($K_1, \ldots, K_4$)*Fn(D)+($Y_1, \ldots, Y_4$)*Fn (SOI,m)+($X_1, \ldots, X_4$)*Fn (SOI, m, I)+ . . . etc. While the forgoing equation is exemplary, additional variables may be readily introduced. Such variables may include peak to peak, peak to end, peak to start, peak to start of injection, peak to top dead center, peak to end of injection, peak to start of combustion, peak amplitudes for each peak, and each of those variable may have their own weighting as indicated above. Each weighting factor $A_n, B_n, C_n, L_n, E_n, F_n, H_n, K_n, \ldots, Y_n$, and $X_n$ may be different based on the in-cylinder variable being measured. Hence, $A_1, B_1, C_1, \ldots X_1$ may be used for soot, while $A_2, B_2, C_2, \ldots, X_2$ may be used for IMEP as illustrated in Table 1. In addition, weighting factors such as $A_n, B_n, C_n, L_n, E_n, F_n, H_n, K_n, Y_n, \ldots, X_n$ may constants or may vary according to a look up table based on other parameters such as ion current sensor location inside the combustion chamber. Further, it is anticipated that other relationship functions may be developed including linear, quadratic, root, trigonometric, exponential or logarithmic components or any combination thereof. Also note that the correlation between the constants mentioned above and the predicted parameters can be expressed as follows:

TABLE 1

| | Constant | | | |
|---|---|---|---|---|
| soot | $A_1$ | $B_1$ | . . . | $X_1$ |
| IMEP | $A_2$ | $B_2$ | . . . | $X_2$ |
| BMEP | $A_3$ | $B_3$ | . . . | $X_3$ |
| FC | $A_4$ | $B_4$ | . . . | $X_4$ |

In one particular example in accordance with the general equation provided above, soot could be predicted according to a function:

soot=$A0$+$A1$(Par1)+$A2$(Par2)+$A3$(Par3)+$A4$(Par4)+$A5$(Par1*Par2)+$A6$(Par1*Par3)+$A7$(Par1*Par4)+$A8$(Par2*Par3)+$A9$(Par2*Par4)+$A10$(Par1*Par2*Par3)+$A11$(Par1*Par3*Par4)+$A12$(Par1^2*Par2^2*Par3^2*Par4^2)

where (Par) stands for an ion current parameter and (A) is a coefficient or weighting.

Figure 4A:
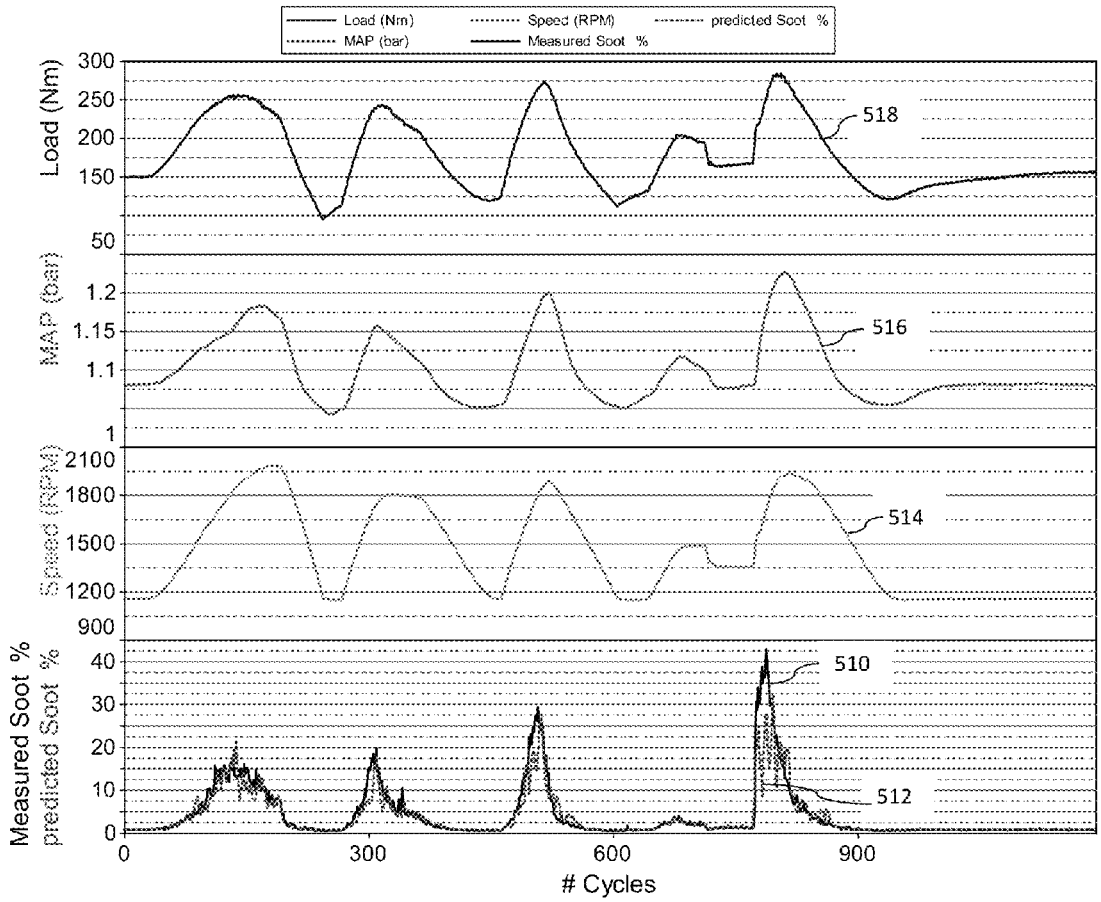
FIG. 4A-C are graphs illustrating the comparison between the measured soot, load and fuel consumption in the engine and the predicted soot, load and fuel consumption based on the analysis of the ion current signal using a full accessed open engine control unit.

Now referring to FIG. 4A, this graph illustrates an engine transient operation at a constant injection pressure where load, intake manifold absolute pressure (MAP), and engine speed vary. As such, the graph represents a comparison between the soot measured in the engine exhaust and the soot predicted by the new technique depending on the function mentioned above. Line 510 represents the measured soot percentage while line 512 represents the expected soot percentage calculated by the algorithm according to the ion current signal. Line 514 represents the speed of the engine. Line 516 represents the intake manifold absolute pressure (MAP) and line 518 is the load of the engine.

From the graph, it is clear that a good correlation between the measured soot and the predicted soot is achieved. The test was conducted based on a transient engine operating condition where engine speed and load were varying. The engine was operated in transient test via an open ECU. The engine speed varied between 1150 and 2000 RPM, load varied between 70 and 220 Nm, injection pressure was kept constant at 400 bar, the engine intake pressure (MAP) varied between 1 and 1.3 bar due to an activated VGT (Variable Geometry Turbocharger).

Figure 4B:
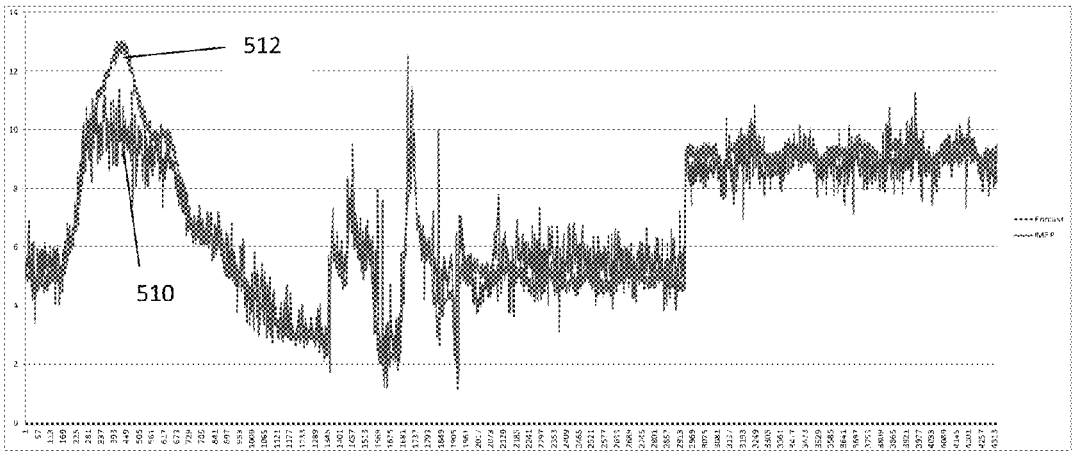

Now referring to FIG. 4B, this graph illustrates an engine transient operation at various loads, injection pressures, intake pressures, speeds, EGR. As such, the graph represents a comparison between the IMEP (Indicated Mean Effective Pressure) 510 measured in the engine cylinder and the predicted IMEP 512 by the new technique depending on the ion current signal parameters mentioned above. From the graph, it is clear that a good correlation between the measured IMEP and the predicted IMEP is achieved.

Figure 4C:
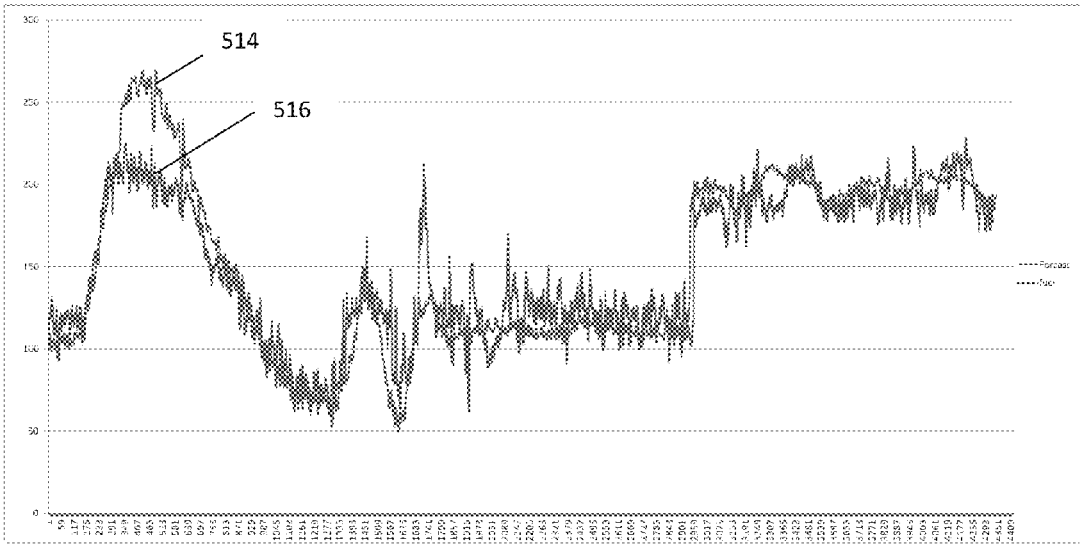

Now referring to FIG. 4C, this graph illustrates an engine transient operation at various loads, injection pressures, intake pressures, speeds, EGR. As such, the graph represents a comparison between the fuel consumption 514 measured for one engine cylinder and the predicted fuel consumption 516 by the new technique depending on the ion current signal parameters mentioned above. From the graph, it is clear that a good correlation between the measured and the predicted fuel consumption is achieved.

Figure 5:
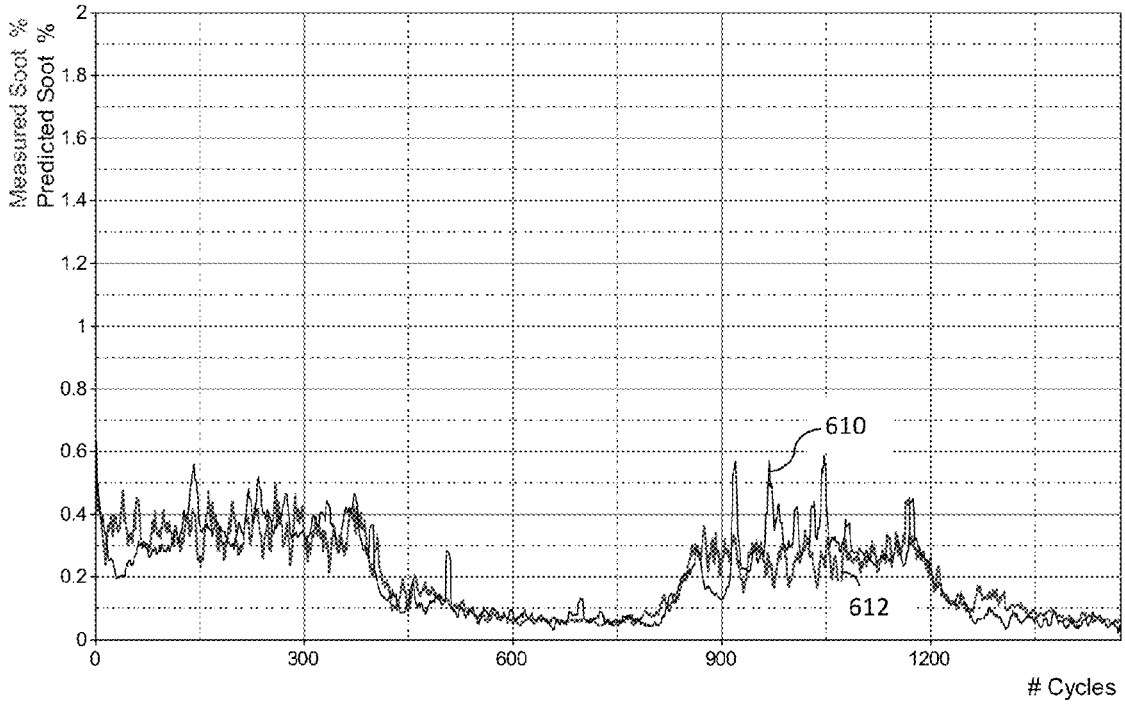
FIG. 5 is a graph illustrating the measured soot in the engine and the predicted soot based on the algorithm used in a closed engine control unit calibrated to emission standards.

FIG. 5 is a graph of the measured soot and the predicted soot as the engine operating parameters are varied for an engine manufacturer control unit that is closed and calibrated to meet emissions specifications. Line 610 is the predicted soot percentage from the ion current while line 612 is the measured soot percentage in the exhaust port of the engine.

The original manufacturer ECU used for this test was calibrated by the manufacturer to produce soot emissions within the EPA standards. The test was developed to see if the predicted soot using the new technique is sensitive enough to capture the very low soot levels emitted. The engine speed was kept constant at 1800 RPM, load (IMEP) varied between 12 and 18 bar, injection pressure varied between 950 and 1150 bar, and intake pressure (MAP) varied between 2.4 and 2.8 bar. The results showed a good match between the measured and predicted soot ranging between 0.05% and 0.6%. The ability to capture the very low soot levels reflects high accuracy and high sensitivity of the described technique.

Figure 6:
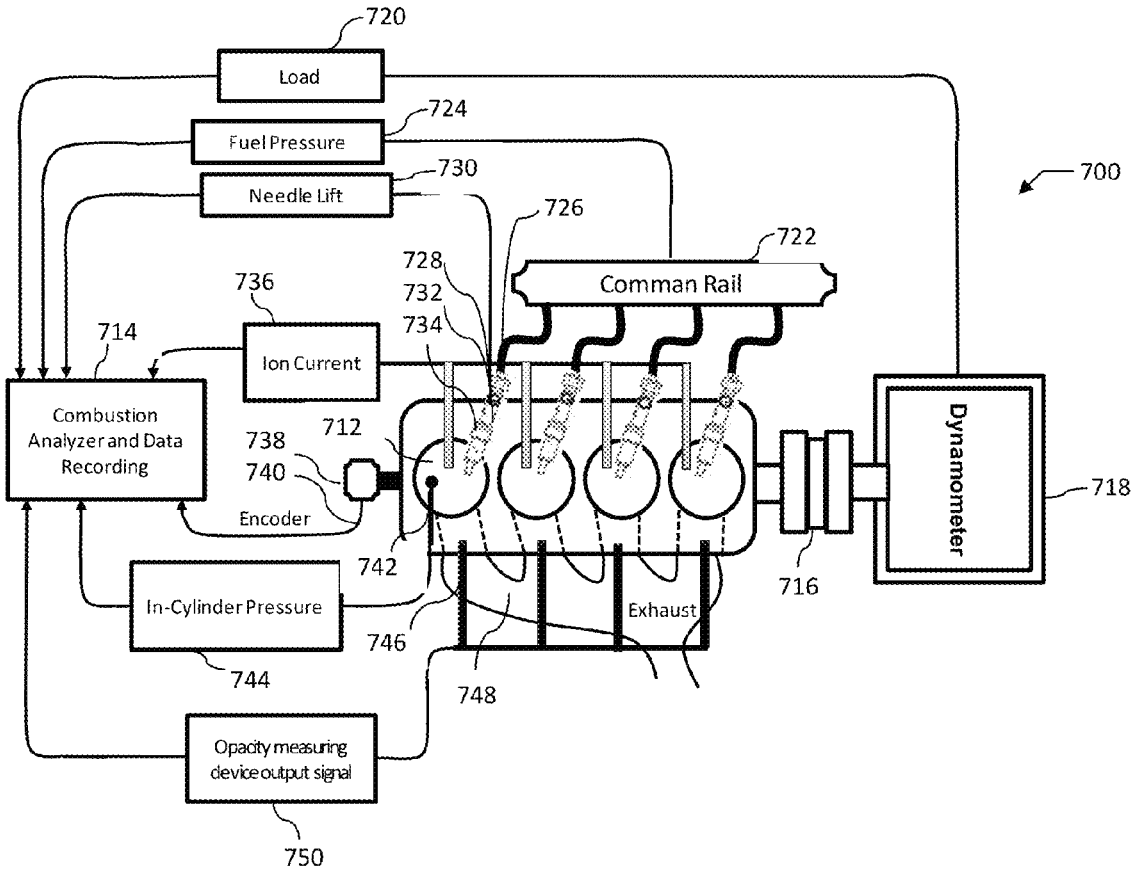
FIG. 6 is a schematic view of an experimental engine layout used to collect the data in the previous graphs and determine the analysis algorithm.

Now referring to FIG. 6, a system is provided for determining the calibration between the ion current signal and the measured soot percentage in the exhaust. The system shown in the figure also determines the calibration between the ion current signal and the measured engine load, and fuel consumption. The experiments in FIGS. 1, 2, 4, 5, and 6 were conducted on a multi-cylinder John Deere diesel engine. The engine is equipped with a common rail injection system and variable geometry turbocharger. The engine specifications are shown in Table 2.

TABLE 2

| | |
|---|---|
| No. of Cylinder | 4 |
| Displacement (L) | 4.5 |
| Bore × Stroke (mm) | 106 × 127 |
| Connecting Rod (mm) | 203 |
| Compression Ratio | 17.0:1 |

The engine system 700 includes an engine 710 with four cylinders 712. Pistons reciprocate in the cylinders 712 to drive the crankshaft 716. The crankshaft 716 may be connected to a dynamometer 718. The dynamometer provides a load signal 720 to a processor 714 for combustion analyzing and data recording. Fuel is provided to the engine through a fuel rail 722, pressure may be monitored in the fuel rail by a fuel sensor which may provide a fuel pressure signal 724 to the processor 714. The fuel may be provided from the fuel rail 722 to the cylinder 712 through a fuel line 726. The fuel may be provided through a fuel needle 728. As such a needle lift signal 730 may be provided to the processor 714 for further analysis in conjunction with the other engine operating parameters. Further, a fuel flow meter is embedded within the fuel line 726 and is used to measure the fuel flow representing engine fuel consumption. It is understood that different fuel measurement devices could be used in this scenario.

The engine may also include a glow plug 732, however, it is readily understood that a spark plug may have been used for other combustion engines. Further, an ion current sensor 734 may be located within the cylinder 712 to measure ion current. The ion current signal 736 may be provided to the processor 714 from the ion current sensor 734. In addition, an inlet cylinder pressure sensor 742 may be located within the cylinder to measure cylinder pressure. The cylinder pressure signal 744 may be provided to the processor 714 by the pressure sensor 742. The processor 714 uses the cylinder pressure signal 744 to calculate the Indicated Mean Effective Pressure (IMEP) for each engine cylinder. BMEP is also calculated. It is understood that IMEP, BMEP are forms of representation of engine load and accordingly can be predicted using the ion current signal. Further, crank position sensor 738 may be connected to the crankshaft to provide an encoder signal 740 to the processor 714, to track the various engine parameters based on the engine crank angle. In addition, a soot measurement device 746 may be provided in an exhaust outlet 748 for each cylinder 712. A soot measurement signal 750 may be provided to the processor 714 by the soot measurement device 746. In one example, the soot measurement device 746 may be an opacity measurement device to optically determine the amount of soot in the exhaust based on opacity. However, it is understood that other soot measurement devices could be used in this scenario.

Figure 7A:
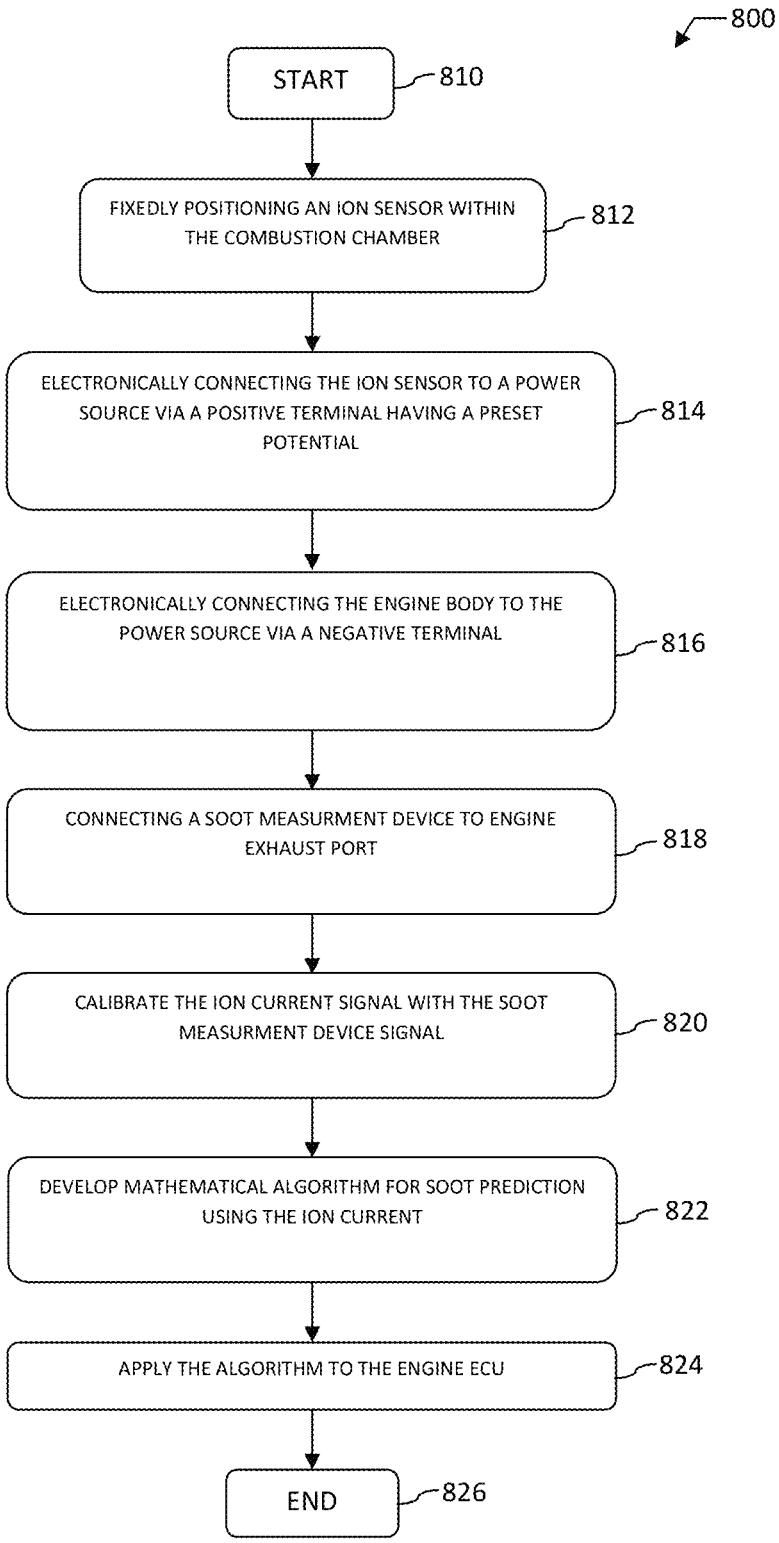
FIG. 7A-C show a flow charts of a calibration procedure to predict the amount of soot, load, or fuel consumption based on the ion current signal.

Now referring to FIG. 7A, a flow chart of a calibration procedure for soot measurement using the ion current signal is provided. The method starts in block 810. In block 812, an ion sensor is positioned within the combustion chamber. In block 814, the ion sensor is electrically connected to a power source through a positive terminal having a preset potential. In block 816, the engine body is connected to the power source through a negative terminal. In block 818, the soot measurement device is connected to the engine exhaust port for measuring the actual soot in the exhaust. In block 820, the ion current signal is analyzed and calibrated with the soot measurement device signal. In block 822, a mathematical algorithm is developed for soot prediction using the ion current signal. In block 824, the algorithm is stored in a storage device for application to the engine control unit. The method ends in block 826.

Figure 7B:
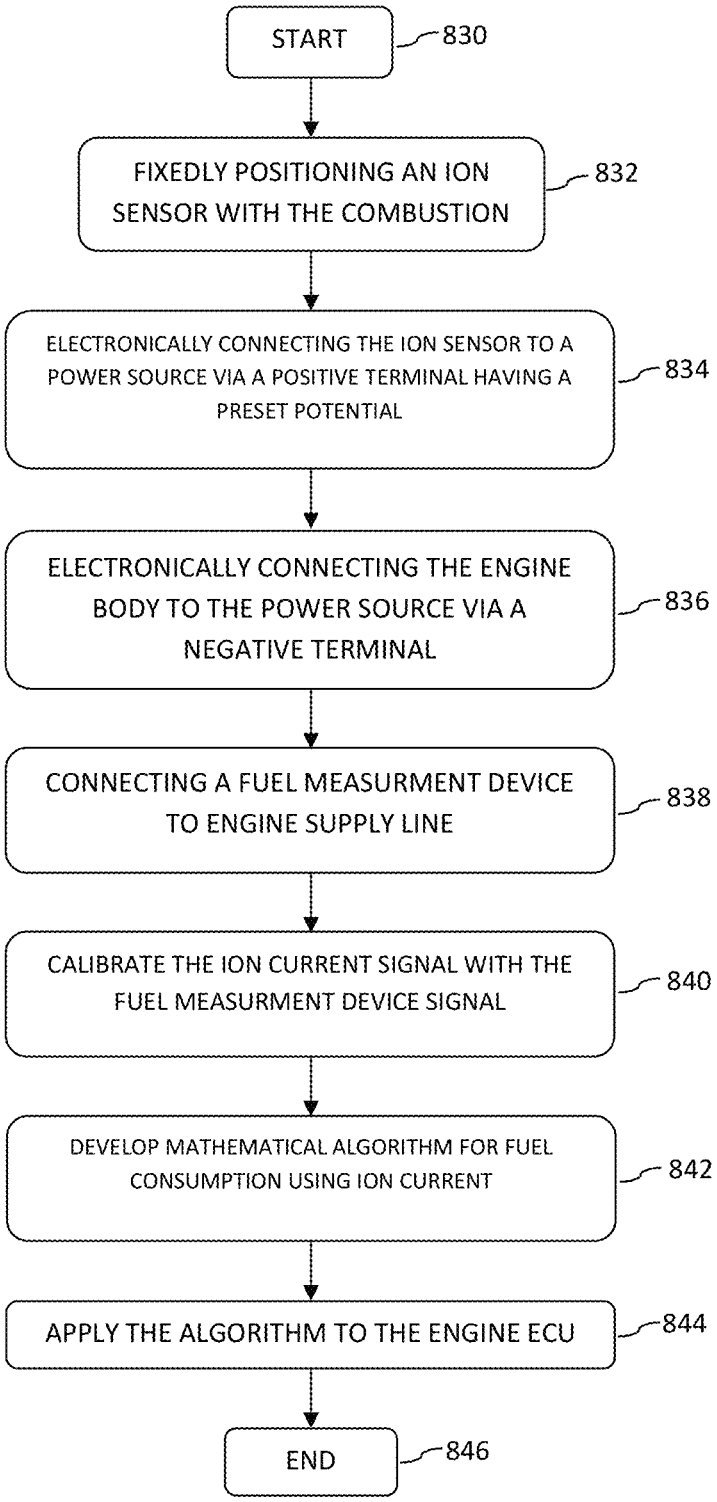

Now referring to FIG. 7B, a flow chart of a calibration procedure for fuel consumption measurement using the ion current signal is provided. The method starts in block 830. In block 832, an ion sensor is positioned within the combustion chamber. In block 834, the ion sensor is electrically connected to a power source through a positive terminal having a preset potential. In block 836, the engine body is connected to the power source through a negative terminal. In block 838, the fuel consumption measurement device is connected to the engine supply line for measuring the actual fuel consumption. In block 840, the ion current signal is analyzed and calibrated with the fuel consumption measurement device signal. In block 842, a mathematical algorithm is developed for fuel consumption using the ion current signal. In block 844, the algorithm is stored in a storage device for application to the engine control unit. The method ends in block 846.

Figure 7C:
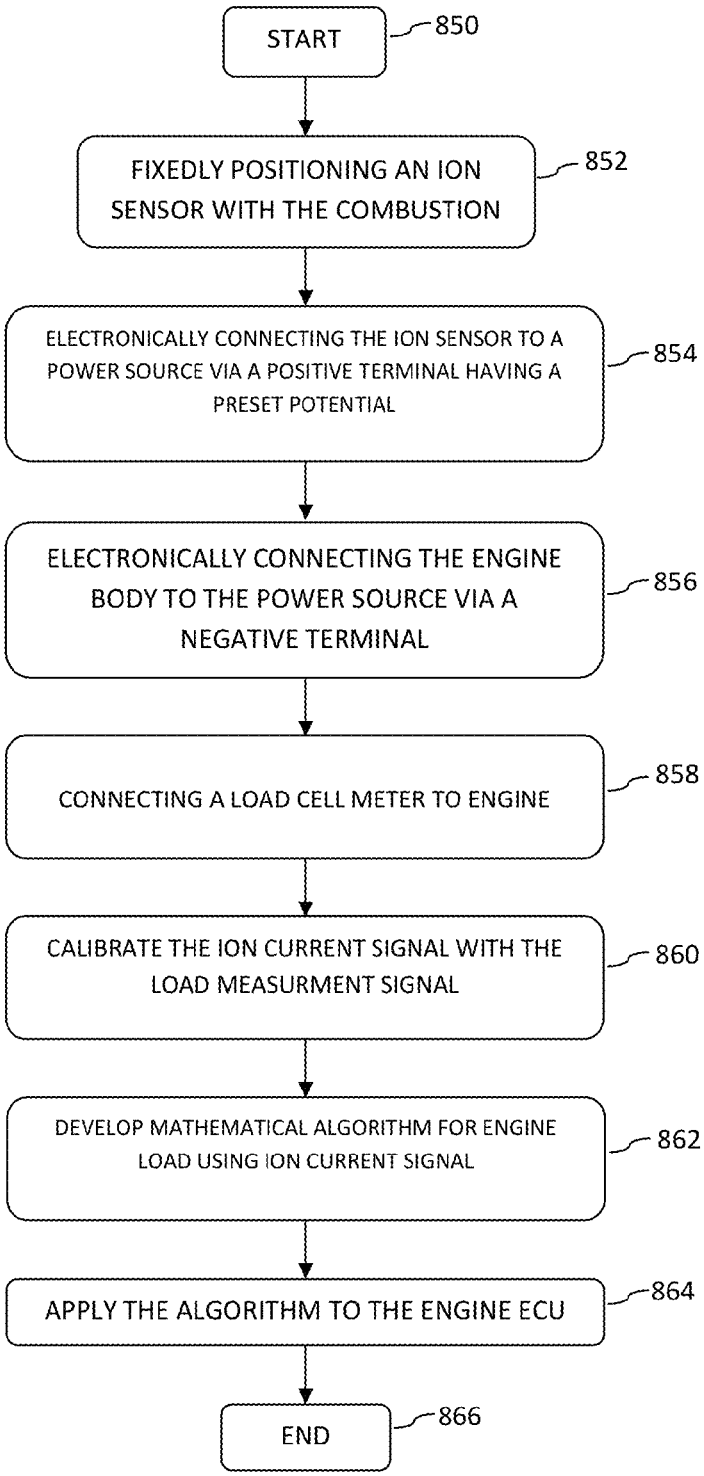

Now referring to FIG. 7C, a flow chart of a calibration procedure for load measurement using the ion current signal is provided. The method starts in block 850. In block 852, an ion sensor is positioned within the combustion chamber. In block 854, the ion sensor is electrically connected to a power source through a positive terminal having a preset potential. In block 856, the engine body is connected to the power source through a negative terminal. In block 858, a load cell meter is connected to the engine for measuring the actual load of the engine. In block 860, the ion current signal is analyzed and calibrated with the load measurement signal. In block 862, a mathematical algorithm is developed for load prediction using the ion current signal. In block 864, the algorithm is stored in a storage device for application to the engine control unit. The method ends in block 866.

Figure 8:
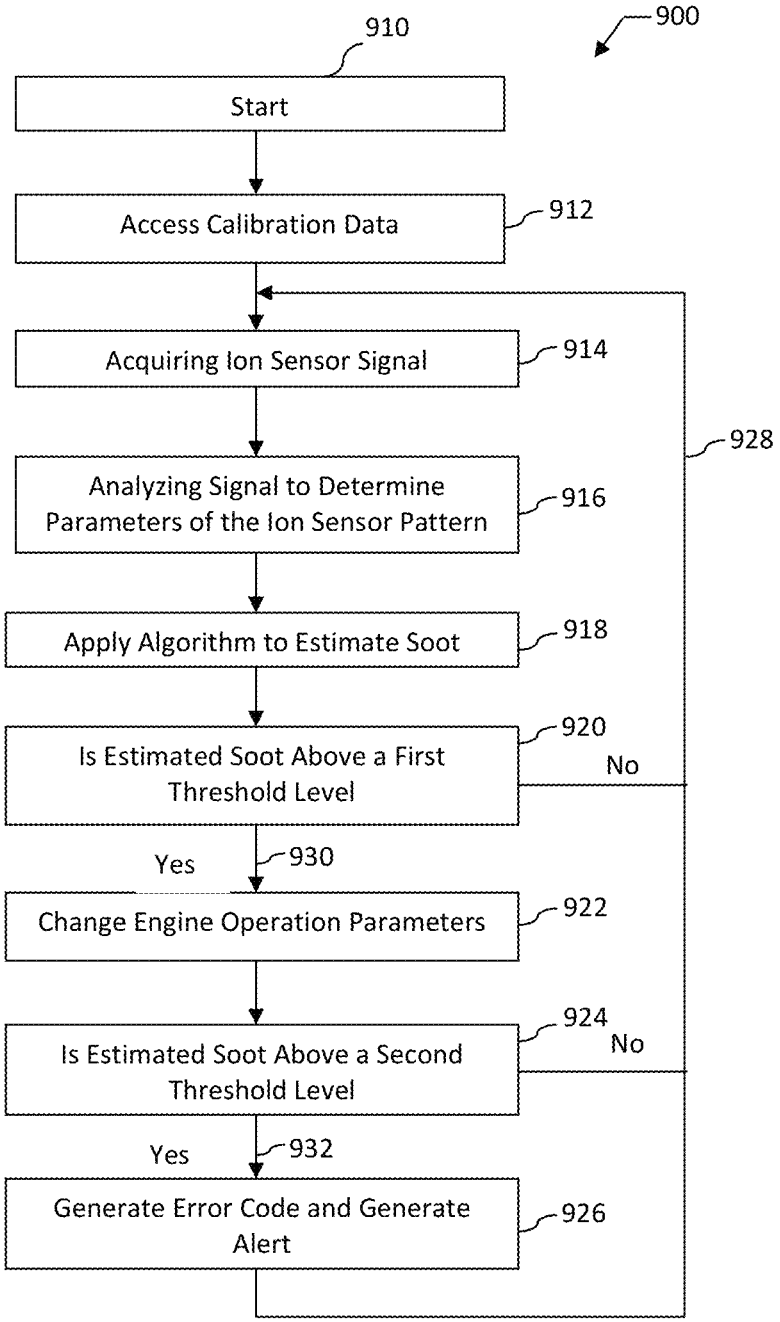
FIG. 8 is a flow chart of a method for controlling the engine based on the ion current signal characteristics.

Now referring to FIG. 8, a method for controlling vision parameters based on the ion current signal characteristics is provided. The method 900 starts in block 910. In block 912, the calibration data is accessed by the engine control unit. In block 914, an ion sensor signal is acquired. In block 916, the ion sensor signal is analyzed to determine the weighting factors of the ion sensor pattern. In block 918, the soot prediction algorithm is applied to the ion sensor signal characteristics to estimate the amount of soot during its formation in the combustion chamber. If the estimated soot is not above a first threshold level, the method follows line 928 to block 914, where the ion sensor signal is acquired again. If the estimated soot is above a first threshold level, the method follows line 930 to block 922. In block 922, the engine control unit may change engine operation parameters of the engine to reduce the amount of soot. In block 924, the engine control unit determines if the estimated soot is above a second threshold level. If the estimated soot is not above a second threshold level, the method follows line 928 to block 914 where the ion sensor signal is acquired again and the method continues. If the estimated soot is above the second threshold level, the method follows line 923 to block 926. In block 926, an error code is generated and/or an alert is provided to the user noting that the engine is experiencing emission problems outside of an acceptable range. The method then follows line 928 back to block 914 where the method continues.

In other embodiments, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Further, the methods described herein may be embodied in a computer-readable medium. The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

We claim:

1. A system for controlling an internal combustion engine, the system comprising an ion current sensor and a control unit in communication with the ion current sensor for receiving an ion current signal, the control unit being configured to predict at least one particulate emission level based on the ion current signal, wherein the control unit is configured to control engine operating parameters based on the sum of multiple functions of one or a combination of multiple ion current signal parameters, the ion current signal parameters including start of the ion current signal, a slope of the ion current signal, area under the curve of the ion current signal, ion current amplitude, and ion current delay.

2. The system according to claim 1, wherein the at least one particulate emission level comprises a soot emission level and/or a black smoke emission level.

3. The system according to claim 1, wherein the control unit is configured control engine operating parameters based on the predicted particulate emission levels from the ion signal.

4. The system of claim 1, wherein the control unit is configured to control engine operating parameters based on a function of one or multiple ion current signal parameters according to the predicted particulate emission levels.

5. The system of claim 1, wherein the control unit is configured to control engine operating parameters based on the sum of multiple functions of one or a combination of multiple ion current signal parameters, wherein each function is weighted prior to summing.

6. The system of claim 1, wherein the control unit can control different engine parameters including at least one of fuel system parameters, air system parameters, ignition system parameters, turbo-charging and supercharging system parameters, valve train system parameters, EGR (exhaust gases recirculation) system parameters, and after-treatment system parameters based on a function of one or more or a combination of ion current signal parameters.

7. The system of claim 1, wherein the ion current sensor is integrated with a glow plug, spark plug, engine gasket, fuel injector, or any electrically insulated probe.

8. The system of claim 1, wherein the control unit determines a predicted soot measurement based on a function of one or more or a combination of ion current signal parameters and the control unit is configured to adjust the engine operating parameters if the predicted soot measurement is above a first threshold.

9. The system of claim 8, wherein the control unit is configured to generate an error code and or alert if the predicted soot measurement is above a second threshold.

10. The system according to claim 1, wherein the control unit is configured to control engine parameters according the predicted particulate emission based on one or more of the ion current signal.

11. A system for controlling an internal combustion engine, comprising: a ion current sensor configured to acquire an ion current signal in the internal combustion engine and a control unit configured to control engine operating parameters based on a function of one or more or a combination of ion current signal parameters, the control unit configured to control engine operating parameters based on the sum of multiple functions, the multiple functions including a function of at least one of a start of the ion current signal, a slope of the ion current signal, area under the curve of the ion current signal, ion current amplitude, and ion current delay.

12. The system of claim 11, wherein the engine operating parameters are controlled based on a function of a combination of ion current signal parameters.

13. The system according to claim 11, wherein the at least one particulate emission level are predicted based on ion current signal parameters comprising at least one of start of the ion current signal, a slope of the ion current signal, area under the curve of the ion current signal, ion current amplitude, or ion current delay.

14. The system according to claim 13, wherein the control unit is configured to control engine parameters according the predicted at least one particulate emission level based on ion current signal parameters comprising at least one of start of the ion current signal, a slope of the ion current signal, area under the curve of the ion current signal, ion current amplitude, or ion current delay.

15. A system for controlling an internal combustion engine, the system comprising an ion current sensor and a control unit in communication with the ion current sensor for receiving an ion current signal, the control unit being configured to predict at least one engine load measurement based on one or more ion current signal parameters from a group of ion current signal parameters including start of the ion current signal, a slope of the ion current signal, area under the curve of the ion current signal, ion current amplitude, and ion current delay.

16. The system according to claim 15, wherein the at least one engine load measurement is an engine load profile.

17. The system according to claim 16, wherein the at least one engine load profile comprises an IMEP profile and/or a BMEP profile.

18. The system according to claim 16, wherein the engine load profile are predicted based on ion current signal parameters comprising at least one of start of the ion current signal, a slope of the ion current signal, area under the curve of the ion current signal, ion current amplitude, or ion current delay.

19. The system according to claim 16, wherein the control unit is configured to control engine parameters according the predicted engine load based on ion current signal parameters comprising at least one of start of the ion current signal, a slope of the ion current signal, area under the curve of the ion current signal, ion current amplitude, or ion current delay.

20. A system for controlling an internal combustion engine, the system comprising an ion current sensor and a control unit in communication with the ion current sensor for receiving an ion current signal, the control unit being configured to predict at least one fuel consumption measurement based on one or more ion current signal parameters from a group of ion current signal parameters including start of the ion current signal, a slope of the ion current signal, area under the curve of the ion current signal, ion current amplitude, and ion current delay.

21. The system according to claim 20, wherein the at least one fuel consumption measurement is a fuel consumption profile.

22. The system according to claim 21, wherein the control unit is configured to calculate an ISFC profile and/or a BSFC profile base on the fuel consumption profile and an IMEP profile and/or a BMEP profile.

23. The system according to claim 21, wherein the at least one fuel consumption profile are predicted based on ion current signal parameters comprising at least one of start of the ion current signal, a slope of the ion current signal, area under the curve of the ion current signal, ion current amplitude, or ion current delay.

24. The system according to claim 21, wherein the control unit is configured to control engine parameters according the predicted fuel consumption profile based on ion current signal parameters comprising at least one of start of the ion current signal, a slope of the ion current signal, area under the curve of the ion current signal, ion current amplitude, or ion current delay.

* * * * *